United States Patent [19]

Wisebaker

[11] 4,395,899

[45] Aug. 2, 1983

[54] FORGING MACHINE FOR PRODUCING RIVETS OR THE LIKE HAVING RUNNING ADJUSTMENTS

[75] Inventor: Robert E. Wisebaker, Tiffin, Ohio

[73] Assignee: The National Machinery Company, Tiffin, Ohio

[21] Appl. No.: 178,178

[22] Filed: Aug. 14, 1980

[51] Int. Cl.[3] ..... B21D 22/00

[52] U.S. Cl. ..... 72/354; 72/356; 72/446; 72/427; 72/11 E

[58] Field of Search ..... 72/448, 446, 441, 356, 72/354; 10/11 E, 11 R, 12.5

[56] References Cited

U.S. PATENT DOCUMENTS

| | | | |
|---|---|---|---|
| 2,935,212 | 5/1960 | Brown | 10/11 E |
| 3,171,144 | 3/1965 | Maistros | 10/11 E |
| 3,200,423 | 8/1965 | Byam et al. | 10/12.5 |
| 3,200,424 | 8/1965 | McCellan | 10/12.5 |
| 3,238,761 | 3/1966 | Hoyt | 10/11 X |
| 3,859,838 | 1/1975 | Karsnak | 10/11 R |

FOREIGN PATENT DOCUMENTS

| | | | |
|---|---|---|---|
| 301772 | 10/1965 | Netherlands | 10/11 E |

*Primary Examiner*—Leon Gilden

*Attorney, Agent, or Firm*—Pearne, Gordon, Sessions, McCoy, Granger & Tilberry

[57] ABSTRACT

A double-blow header particularly suited for producing semitubular rivets is disclosed. The header is provided with three separate adjustments for controlling the position and operation of the extrusion pin, all of which can be adjusted while the machine is operating. A first adjustment determines the rearwardmost position of the extrusion pin and, in turn, adjustably determines the mass of material contained within the shank of the workpiece. A first powered drive adjustably determines the stroke of the extrusion pin during a piercing operation without altering the rearwardmost position thereof. A second powered drive adjustably determines the kickout stroke without altering the final position of kickout. The kickout drive adjustment and the first adjustment are interconnected so that both of them are adjusted in a related manner.

14 Claims, 8 Drawing Figures

FORGING MACHINE FOR PRODUCING RIVETS OR THE LIKE HAVING RUNNING ADJUSTMENTS

BACKGROUND OF THE INVENTION

This invention relates generally to cold headers and, more particularly, to a novel and improved forging apparatus with adjustable drives which is particularly suited for producing rivets or the like in a single-die, double-blow header.

PRIOR ART

U.S. Pat. Nos. 3,200,423 and 3,200,424 both discloses single-die, double-blow headers for the manufacture of semitubular rivets, i.e., rivets having tubular portions extending along a portion of the shank from the end remote from the head. Both such machines require a sliding die which slides back and along an extrusion punch to form the tubular or skirt portion of the rivet.

In the Byam U.S. Pat. No. 3,200,423, the die is locked in its forward position during the first stroke and the blank or workpiece is coned during that stroke. During the second stroke, the die slides back with respect to the extrusion punch to produce the tubular portion and the head is finished.

In the McClellan et al. U.S. Pat. No. 3,200,424, assigned to the assignee of the present invention, the die slides back over the extrusion pin during the first stroke to form the tubular portion of the rivet and the head end is upset only a minimal amount during such stroke. At the completion of the first stroke and during the second stroke, the die is locked in its rearward position. Before the second stroke, and while the die is locked in its rearward position, the extrusion pin is fed forward to move a portion of the blank beyond the die face, and during the second stroke, the projecting portion is upset to the finished head.

SUMMARY OF THE INVENTION

The present invention provides a simplified, single-die, double-blow header for producing rivets or the like. With such machine, the die is not slidable. This results in simplified tooling and eliminates entirely the requirement for an operating die lock to hold a sliding die during a portion of the machine cycle.

The machine and the tooling are arranged so that the shank length of the rivet and the length of the tubular portion of the shank can be changed without any tooling change. In fact, such changes can be made while the machine is running. With such running adjustments, it is possible for the machine operator to determine the dimensional accuracy of the rivets being produced and to make the machine adjustments to correct any inaccuracy noted without stopping the machine. Such running adjustment is highly desirable, since it can be performed while the operation of the machine is stabilized. Such adjustments are made without affecting the machine timing and without requiring replacement of any of the parts.

In the illustrated embodiment, the first stroke is used to cone the blank or workpiece without significant working of the shank end of the workpiece. Normally during the coning stroke, the only working at the shank end involves a slight penetration of the tapered end of the extrusion punch.

During the second stroke, two separate operations are performed in a timed relationship. The coned end of the workpiece is upset to its finished shape and the extrusion punch is pressed into the shank end of the workpiece to extrude the tubular portion of the shank. This piercing extrusion movement of the extrusion tool is timed to occur during a very short period of time, commencing after the upsetting operation is substantially completed, and is finished before the heading tool moves any significant distance away from the die face.

Three separate but related adjustments are provided for positioning the extrusion pin. Two such adjustments involve powered drive systems for moving the extrusion pin and the third adjustment involves the positioning of the extrusion pin backup screw, which in turn determines the rearwardmost position of the extrusion pin and the shank length of the rivet.

The first power drive, referred to as the "pierce drive," operates to move the extrusion pin forward to pierce the shank and to form the tubular portion thereof. The second power drive, referred to as the "kickout" or "knockout" drive, operates to move the extrusion pin forward to eject the finished rivet from the die while the tools are spaced back from the die.

Both of these two powered drives can be adjusted while the machine is operating, or while the machine is shut down. Adjustment of these two power drives along with the adjustment of the backup screw permits the machine to be changed from producing rivets of one shank length to rivets of another shank length, or changed to change the length of the tubular portion of the rivet without any tooling change.

As mentioned previously, the backup screw is adjusted to determine the innermost position of the extrusion pin adjustment. This adjustment operates to establish the amount of material in the shank.

The adjustment of the pierce drive determines the stroke of the extrusion pin during the extrusion operation in which it penetrates into the shank end of the rivet to form the tubular portion thereof. Adjustment of this drive does not in any way change the initial position of the extrusion pin, but merely adjusts the length of the extrusion stroke and, in turn, the final position of the extrusion pin at the completion of the extrusion operation.

The kickout drive or knockout drive is adjustable for various strokes without modifying the final position of the extrusion pin. Adjustment of this drive, therefore, establishes the position of the drive elements immediately before the kickout operation has commenced.

In the illustrated embodiment, the adjustment of the kickout backup screw and of the kickout drive is mechanically interconnected by a chain drive so that there two adjustments are changed in a related manner. For example, if the kickout backup screw is adjusted forward to reduce the distance through which the workpiece initially projects into the die, the knockout drive is automatically adjusted to move forward a corresponding distance and correspondingly reduce the stroke of the knockout drive. The interconnection between the two adjustments is, however, arranged so that the knockout drive cannot encounter working loads.

Both of the power drives are provided with levers having curved camming surfaces engaged by followers at one end of the driven linkage. These levers are, in turn, driven by cams powered from the half-speed drive of the double-blow header. Each lever cam surface is formed with a radius of curvature and a center of curvature which coincides with the pivot axis of the associated follower link when the associated cam lever is in one extreme position of its operation. When in such position, adjustment of the follower along the face of the cam surface does not cause movement of the follower link pivot, although it does change the position of such pivot when the associated cam lever moves to its other position.

The center of curvature of the cam coincides with the pivot axis of the follower link of the pierce drive when its cam is in the extreme position for establishing the rearward position of the drive. Therefore, adjustment of the follower along the face of the pierce cam surface does not affect the rearward position of the drive, but only the stroke through which the drive operates. On the other hand, the kickout cam surface is provided with a center of curvature which coincides with its associated follower link pivot when the kickout cam lever is in the extreme position reached at the completion of the kickout stroke. In such situation, adjustment of the cam follower along the surface does not change the final position of the kickout drive but only the initial position.

Each of the drives is adjusted by a floating link connected to an adjustable support screw which fits through a bushing mounted on the machine frame. By rotating the adjustment bushing, the position of the floating link is changed and a corresponding change occurs in the position of the follower link of the associated drive system.

The adjustment of the kickout linkage is connected to the adjustment of the backup nut which determines shank length so that proper clearance in the kickout drive is maintained to ensure that excessive pounding does not occur.

DETAILED DESCRIPTION OF THE DRAWINGS

An apparatus incorporating the present invention is illustrated as applied to a double-blow header for the forging of tubular rivets. However, it is within the broader aspects of this invention to apply the apparatus to other types of forging machines for the production of other types of articles.

Figure 1:
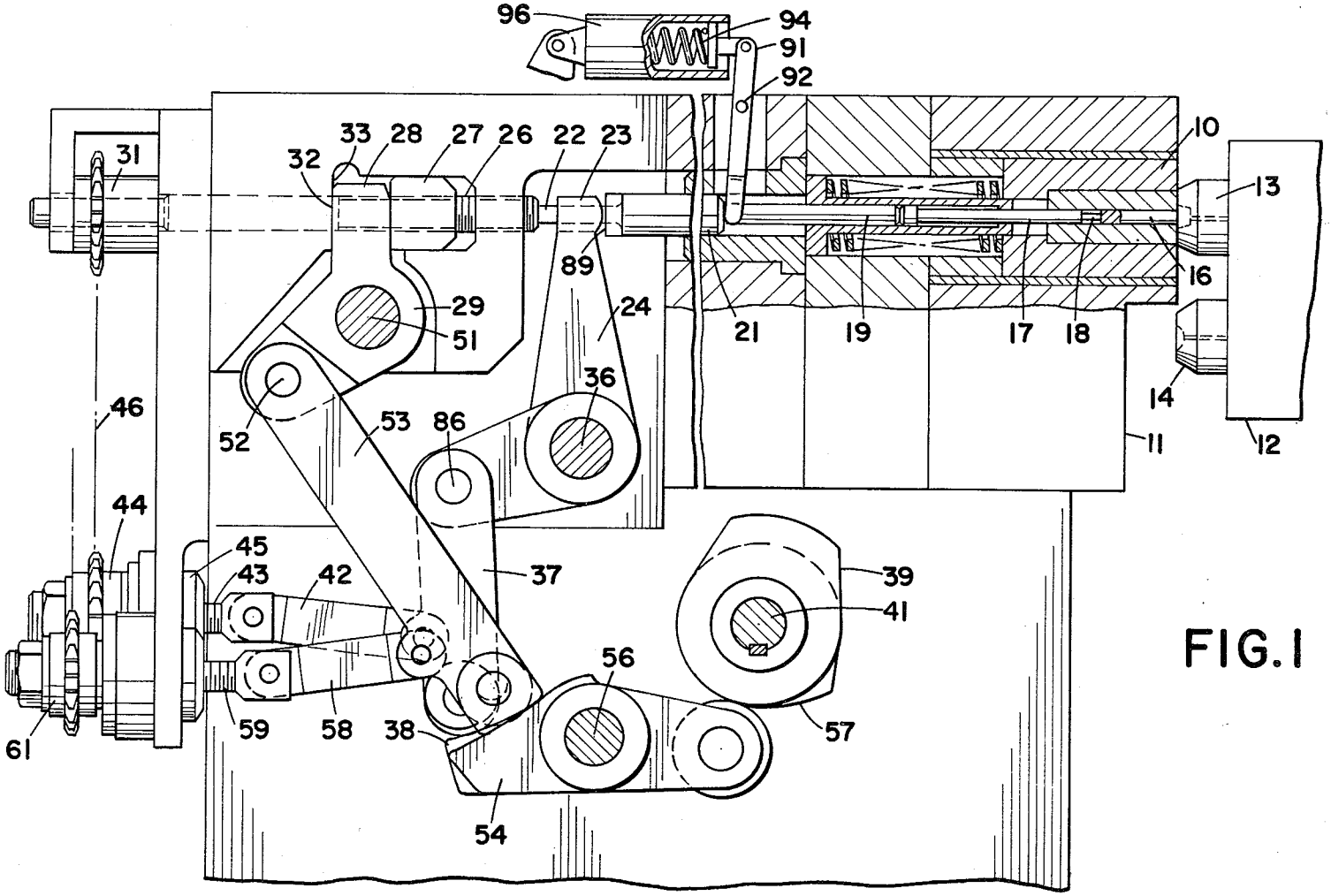
FIG. 1 is a longitudinal section through the die station illustrating the basic tooling structure and the structure of the extrusion pin adjustments including the drives for moving the extrusion pin to perform the piercing operation and the kickout operation.
Figure 2:
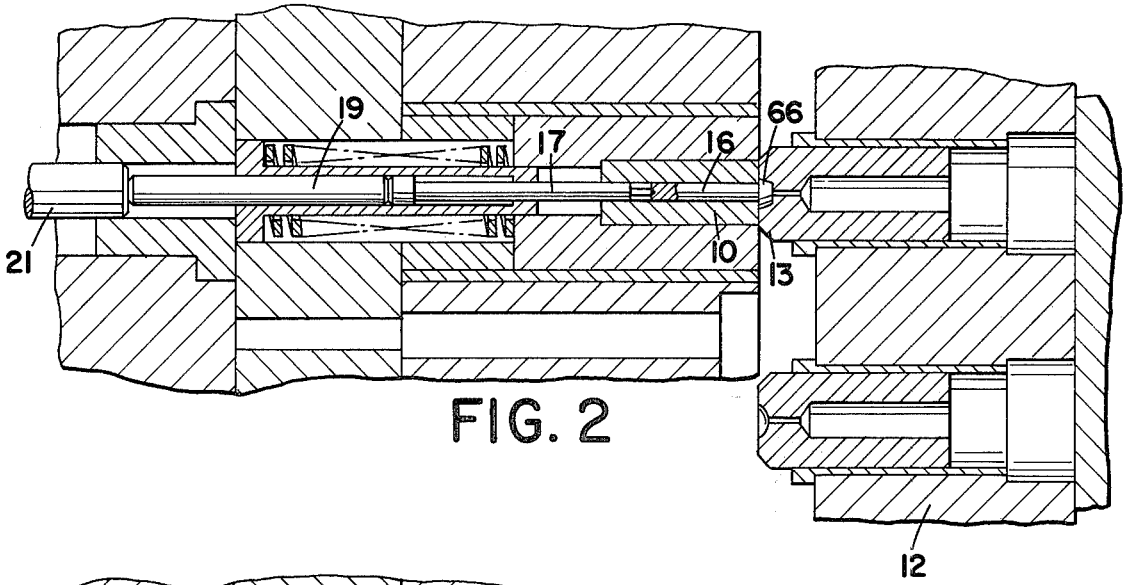
FIG. 2 is a fragmentary section of the die station illustrating the tooling at the completion of the coning stroke, which is the first working stroke on the workpiece.

Referring to the drawings, FIG. 1 illustrates the single die station of the double-blow header, in which a die 10 is supported in the frame 11 of the machine. A reciprocating slide assembly 12 carries a pair of tools, including a coning tool 13 and a finishing tool 14, which are shifted back and forth in timed relation to the operation of the machine so that the coning tool 13 cones a workpiece 16 on a first stroke and the finishing tool 14 finishes the head of the workpiece on a subsequent stroke. The tooling illustrated is for the production of a tubular rivet.

Projecting into the rearward end of the die 10 is a tool 17. In the illustrated embodiment, the tool 17 is an extrusion pin formed with a reduced diameter extrusion projection 18 on the forward end thereof. The end of the extrusion projection 18 is conical. As discussed in greater detail below, this pin determines the length of the shank of the rivet, extrudes a tubular section at the inner end of the shank, and operates to eject the finished rivet from the die 10 into a stripper.

Positioned rearwardly of the extrusion pin 17 is a backup pin 19 which engages the rearward end of the extrusion pin at its forward end and engages a drive pin 21 at its rearward end. The drive pin is provided with a reduced diameter extension 22 which extends between the forked upper end 23 of a knockout lever 24 and engages at its rearward end a backup screw 26. A backup screw adjusting nut 27 is threaded onto the adjusting screw 26. This nut is shaped to slide within a cavity in the frame, but is restrained against rotation. The adjusting screw 26 extends through a forked upper portion 28 of a pierce drive lever 29 and rearwardly through a sprocket wheel 31 which is keyed to the adjusting screw 26 to prevent relative rotation therebetween while allowing relatively free axial movement between the sprocket wheel and the adjusting screw.

In the rearward position illustrated, the pierce lever 29 is in one extreme position in which the rearward side 32 of the forked portion engages a backup surface 33 on the frame 10 and its forward side engages the backup screw adjusting nut 27. Consequently, the pin system cannot move rearwardly beyond the illustrated position, but such illustrated position is adjustable by rotating the sprocket wheel 31, and in turn the adjusting screw 26, within the nut 27, as described in greater detail below.

The kickout linkage includes the kickout lever 24, which is pivoted for limited reciprocating rotation about a pivot axis 36, a drive link 37, a kickout drive lever 38, and a kickout cam 39 which is mounted on a drive shaft 41 driven by the half speed shaft of the double-blow header. Adjustment of the kickout linkage is provided by a floating link 42 pivoted at one end on the drive link 37 and at its other end on an adjusting screw 43. The adjusting screw is adjusted in or out, as desired, by rotation of a second sprocket wheel 44, which is keyed to a tubular screw 45 to prevent relative rotational movement therebetween. A chain drive 46 interconnects the two sprocket wheels 31 and 44 so that they rotate in unison, as discussed below.

The pierce linkage includes the pierce lever 29, which is pivoted for reciprocating rotation about the axis 51 and is pivotally connected by pivot 52 to a drive link 53. The drive link 53, in turn, is operated by a pierce drive lever 54 which is pivoted for rotation about an axis 56 and is driven by a pierce cam 57, also mounted on the drive shaft 41. Here again, a floating link 58 is pivoted at one end on the drive link 53 and at its other end on an adjusting screw 59 which is adjusted by a sprocket wheel 61.

The pierce drive is adjustable to adjust the stroke of the extrusion pin 17 for extruding the tubular portion of the workpiece 16, with such adjustment arranged so that the rearward position of the drive linkage does not change but only the forward or extruded position. The manner in which this is accomplished is discussed in detail below.

Similarly, the kickout drive linkage is adjustable to adjust the kickout stroke. However, in the case of the kickout linkage, adjustment of the kickout stroke does not alter the kickout position of the extrusion pin 17, but only the initial position.

FIGS. 2 through 5 illustrate the operations performed on the workpiece 16 as it is formed to produce a finished tubular rivet. The workpieces are normally sheared from wire or rod stock by a shear (not illustrated) and are transferred automatically to a position in front of the die 10. Such workpieces are engaged by the coning tool 13, which moves the blank in along the cylindrical die 10 until the inner end thereof engages the conical forward end of the extrusion pin 17. This prevents any significant additional inward movement of the workpiece and continued movement of the coning tool commences an upset on the projecting end of the workpiece 16.

After completion of the coning stroke, the workpiece 16 is slightly indented at its inner end against the forward end of the extrusion pin and the outer end of the workpiece is coned or partially upset at 66. The engagement of the inner end of the workpiece 16 with the forward end of the extrusion pin 17 causes a swelling of the workpiece and provides sufficient resistance to continued movement of the workpiece into the die 10 to cause commencement of the coning operation. As soon as the coning commences, a shoulder is developed at the outer end of the workpiece engaging the face of the die 10 to prevent further inward movement of the workpiece. The rearwardmost position of the extrusion pin 17 therefore determines the amount of material of the workpiece actually received within the die 10. By providing a full coning operation, it is also possible to produce shouldered rivets by substituting a proper die for such purpose.

Figure 3:
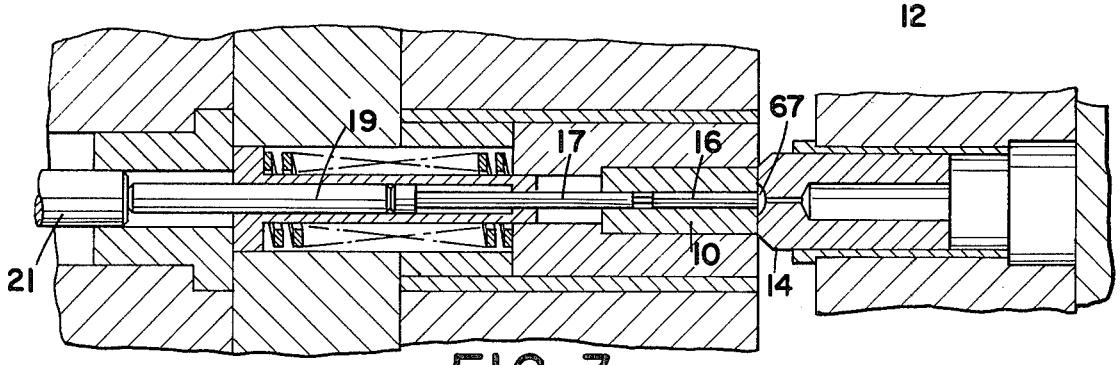
FIG. 3 is a view similar to FIG. 2, but illustrating the second or finishing blow at a point in the cycle in which the head is substantially finished and prior to the piercing operation.

As the slide assembly 12 moves back away from the die, the tools are shifted to align the finishing tool 14 with the die 10 and during the second stroke of the slide assembly 12, the finishing tool 14 forms the projecting end of the workpiece to the finished head shape illustrated in FIG. 3 at 67.

Figure 4:
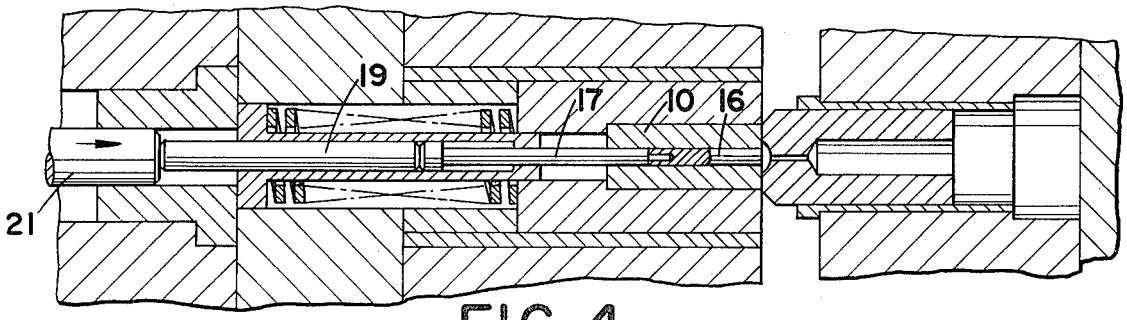
FIG. 4 is a view similar to FIGS. 2 and 3, but illustrating the tooling at the completion of the piercing operation.

In accordance with the method of producing rivets illustrated, the extrusion operation is commenced when the finishing tool is substantially at its forward dead center position illustrated in FIG. 3. Such extrusion operation involves the driving of the extrusion pin 17 forward by the pierce drive while the finishing tool 14 is substantially at its forward dead center position, with the extrusion operation being completed before the finishing tool 14 retracts to any material extent from such forward dead center position. This extrusion operation involves the pressing of the extrusion pin 17 into the inner end of the workpiece 16, as illustrated in FIG. 4.

In practice, the piercing operation should be timed to occur within the shortest possible time, while the finished tool 14 is substantially at its forward dead center position. When the slide assembly is driven by a crank and pittman drive, it is preferable to arrange the piercing operation so that it occurs within a period which does not substantially exceed about 30 degrees of crankshaft rotation, with the pierce operation beginning at a crankshaft position not appreciably more than 20 degrees before forward dead center and being completed before the crankshaft is more than about 10 degrees beyond forward dead center position. Because of the crank and pittman-type drive in which the movement of the slide, and in turn the tool, is not appreciable as the crank approaches the forward dead center position and immediately after it passes such position, the finished tool 14 is substantially at the forward position during such period of time.

Figure 5:
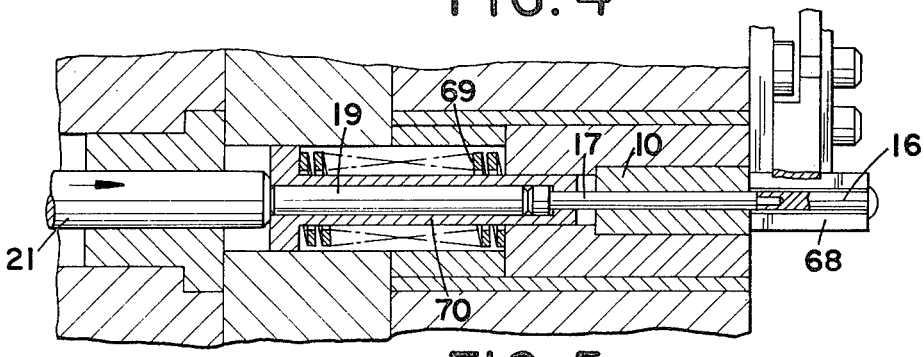
FIG. 5 is a view similar to FIGS. 2 through 4, but illustrating the mechanism at the completion of the kickout operation in which the workpiece is positioned within the stripper.

After the completion of the second working stroke, and while the tools are spaced back from the die, the extrusion pin is moved to the injection position of FIG. 5, ejecting the finished rivet from the die, where it is picked up by a stripper 68. As illustrated in FIG. 5, a compression spring 69 is compressed by the extension of the extrusion pin 17 so that as the backup pin 19 moves back from the position of FIG. 5, the compression spring, through the action of a guide element 70, pulls the extrusion pin 17 out of the finished rivet so that it can be ejected from the machine and a subsequent workpiece position for forming in a subsequent machine cycle.

The method of forming a rivet as disclosed utilizing different apparatus is known, and such method forms no part of this invention, except as it relates to the apparatus per se.

Figure 7:
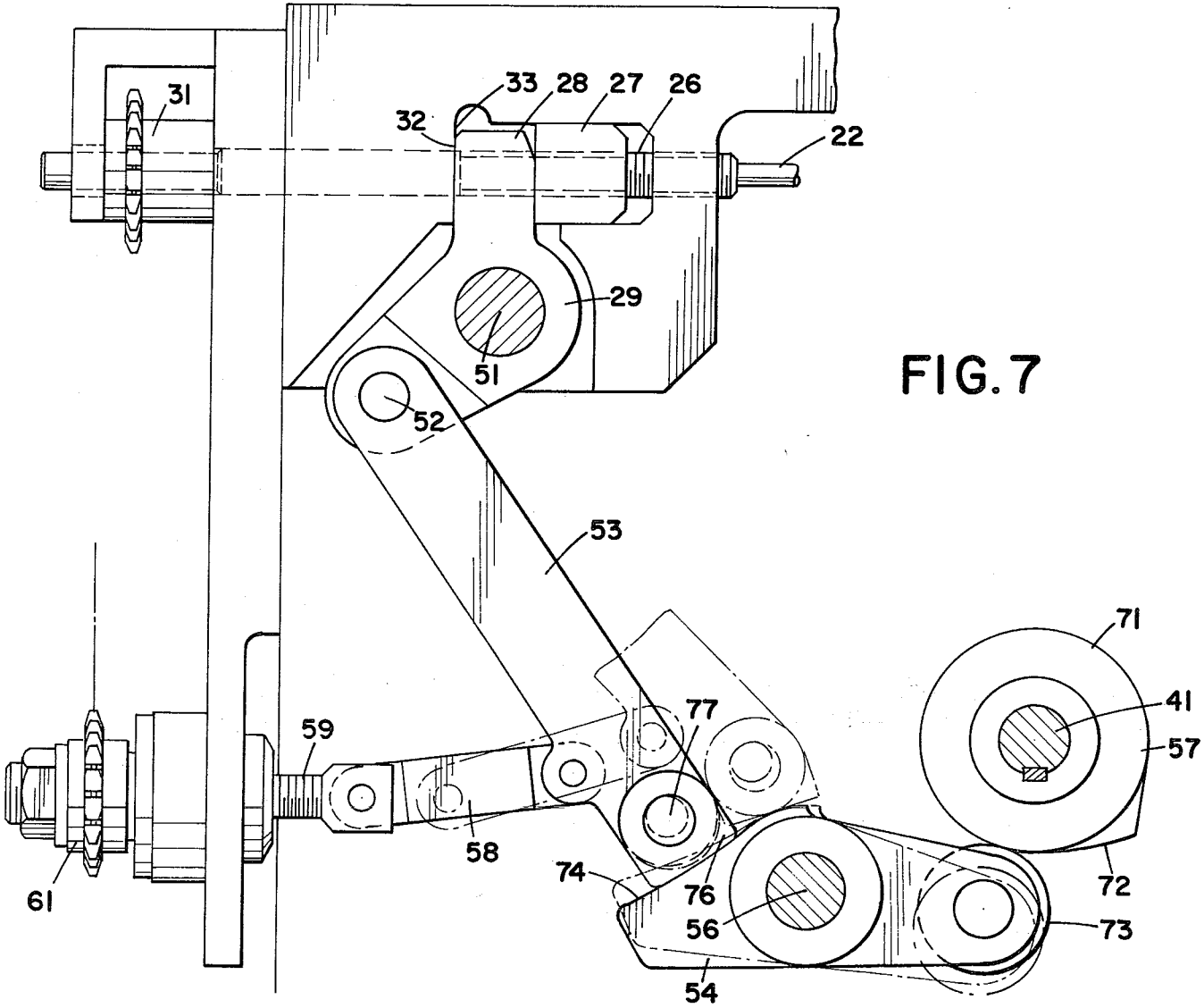
FIG. 7 is an enlarged, fragmentary view illustrating the structure and the operation of the pierce drive and the manner in which it is adjusted.

Reference is now made to FIG. 7, which illustrates the pierce drive linkage system. As mentioned previously, the pierce drive cam 57 is mounted on a drive shaft 41 powered by the half-speed drive system of the machine in timed relation to the operation of the machine. This cam includes a dwell portion 71 and a lobe 72 which is engaged by a cam follower 73 pivotally mounted on the drive lever 54 of the linkage. The drive lever is caused to oscillate about the pivot 56 when the follower 73 is engaged by the lobe 72. When the follower 73 engages the dwell portion 71 of the cam 57 the drive lever 54 assumes the full-line position and when the follower moves along the top surface of the lobe 72, the drive lever assumes the phantom line position. A spring-loaded follower engages a mating cam to ensure that the follower 73 remains in contact with the drive cam 57 at all times. Such spring-loaded follower and mating cam, however, are not illustrated in order to simplify the understanding of this invention, but such structure is known to those skilled in the art.

The left end of the drive lever 54 is formed with a curved cam or drive surface 74 engaged by a follower shoe 76 which is pivotally mounted at 77 on the lower end of the drive link 53. Preferably, the pivot 77 for the shoe 76 is an eccentric pivot to provide a limited adjustment of the linkage to compensate for manufacturing tolerances, as discussed below. The curved surface 74 is shaped so that it has a radius of curvature and a center of curvature which coincide with the pivot axis 52 when the follower 73 is in engagement with the dwell portion 71, (the full-line position illustrated in FIG. 7). The shoe 76 is also provided with the same radius of curvature along the surface which engages the surface 74.

With such structure, movement of the link 53 and, in turn the shoe 76, inwardly or outwardly along the surface 74 does not change the position of the pivot axis 52 while the drive lever 54 is in the full-line position. Therefore, adjustment of the position of the link 53, as discussed below, does not affect the position of the pierce lever 29 so long as the follower 73 is in engagement with the dwell 71. The eccentric 77 is adjusted to provide a very slight clearance between the shoe 76 and the surface 74 when the rearward surface 32 of the lever 29 is in engagement with the surface 33 on the frame of the machine and the follower 73 engages the dwell 71. This ensures that the upsetting loads are transmitted directly back to the machine frame and are not carried by the pierce drive linkage.

Adjustment of the stroke of the pierce drive, however, is determined by threading the adjustment screw 59 inwardly or outwardly, as the case may be, to adjust the position of the shoe 76 with respect to the surface 74. If an increased pierce stroke is required, the adjustment screw 59 is threaded to the left as viewed in FIG. 7 to pivot the drive link in a clockwise direction from the position illustrated so that the shoe 76 engages the surface 74 at a location closer to the leftward extremity of the surface 74. Such adjustment causes an amplification of the movement of the link 53, and in turn the lever 29, when the drive lever 54 moves to the phantom position. This, in turn, increases the pierce stroke. Conversely, if the adjusting screw 59 is adjusted to the right as illustrated in FIG. 7, the shoe moves to a position more in alignment with the pivot axis 56 and the pierce stroke is decreased. Because the adjusting screw 59 does not move during the operation of the linkage, except when it is being adjusted, it is possible to adjust the stroke of the piercing operation while the machine is running from a stroke of essentially zero to the full stroke of the mechanism.

The ability to adjust the pierce stroke while the machine is in operation is an important feature of this invention in that it allows the machine operator to make critical adjustments while the machine is operating in a stabilized condition and eliminates the requirement for stopping the machine to make adjustments of the pierce stroke.

The linkage of the pierce drive is quite heavy so that it can absorb the loads required to extrude the tubular portion on the inner end of the rivet. As the drive lever 54 rotates in a clockwise direction toward the phantom position, the pierce lever 29 is also rotated in a clockwise direction through a distance determined by the adjustment of the screw 59. This causes the upper end of the drive lever to move the backup nut 27 to the right and, in turn, causes the various pins to move the extrusion pin 17 into the inner end of the blank to extrude the tubular portion thereof.

Figure 6:
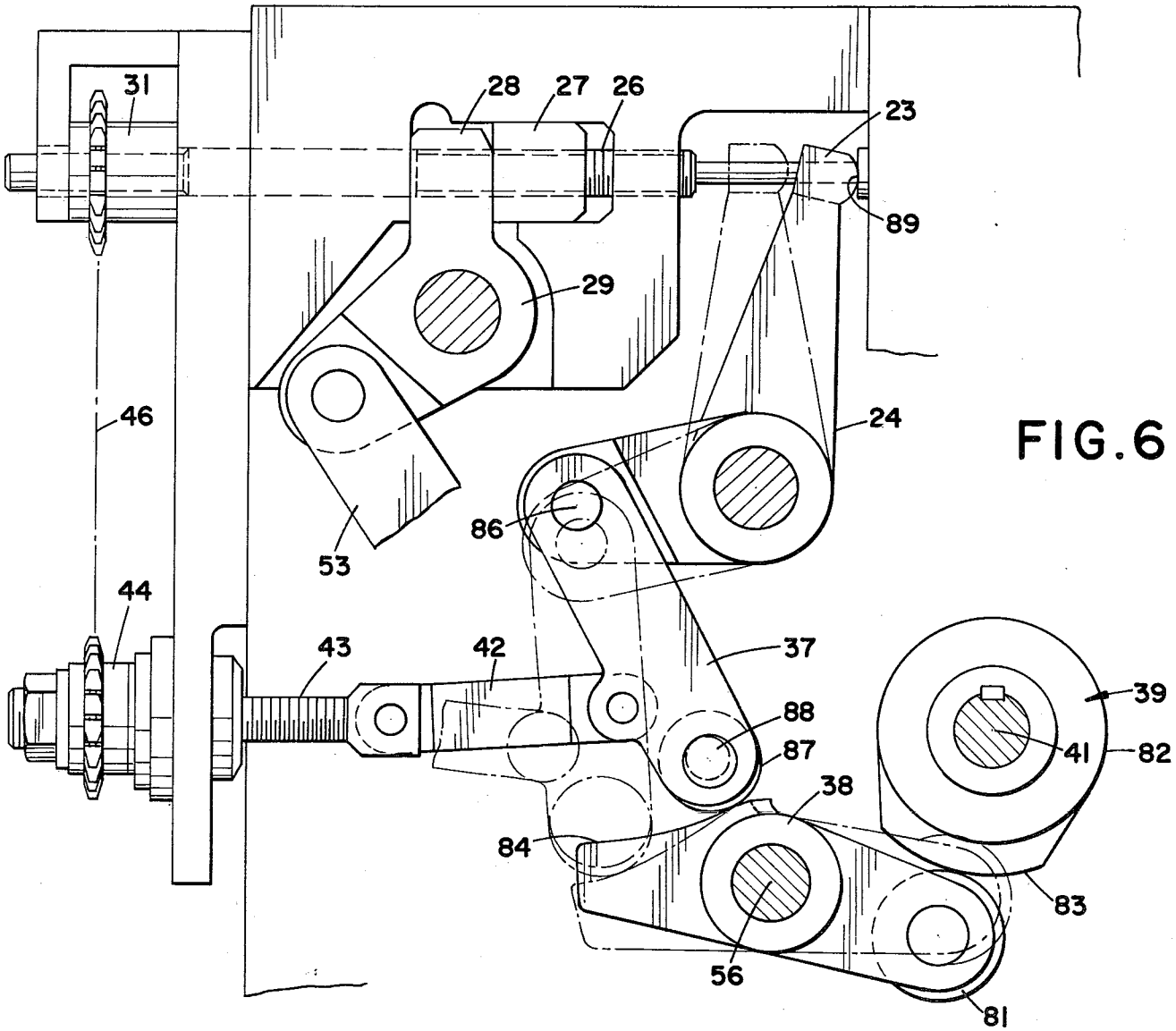
FIG. 6 is an enlarged, fragmentary section of the kickout drive illustrating in phantom the adjustment of the drive.

The kickout drive linkage is best illustrated in FIG. 6. Here again, the drive lever 38 is provided with a cam follower 81 which engages the kickout drive cam 39. This cam is provided with a dwell portion 82 and a lobe 83 which cause oscillating rotation of the lever 38 about its pivot 56 as the cam is rotated by the drive shaft 41. In the instance of the kickout adjustment, however, it is desired to provide a running adjustment of the linkage which changes the stroke without changing the final kickout position. Therefore, this linkage is provided with a curved surface 84 on the left end of the drive lever 38, which has a radius of curvature and center of curvature which are coincident with the pivot axis 86 connecting the link 37 to the lever 24 when the follower 81 is engaging the flat at the top of the lobe 83 and the linkage is in the full-line position.

Here again, a cam follower 87 is mounted on the lower end of the link 37 for engagement with the surface 84, and is moved inwardly or outwardly along such surface by adjustment of the screw 43. However, since the center of curvature of the surface 84 is coincident with the pivot axis 86 when the kickout linkage is in the operative position, adjustment of the screw 43 does not alter the final kickout position, but only the rearward or initial position, which is the phantom line position of FIG. 6. When it is desired to move the rearward position of the extrusion pin back from the face of the dies to increase the shank length of the workpiece, the screw 43 is threaded in a direction to the left, as illustrated in FIG. 6, causing the follower to move further from the pivot axis so that a greater stroke is provided. Conversely, when a smaller kickout stroke is desired, the screw 43 is threaded to the right as viewed in FIG. 6 to cause the cam follower 87 to move to the right. The cam follower 87 is again mounted on an eccentric pivot 88 to provide close adjustment and to ensure that when the kickout linkage is in the rearward position, a slight clearance (illustrated in FIG. 1) will be provided between the forked upper end 23 of the lever 24 and the surface 89, which is engaged during the kickout driving operation. This ensures that forming loads are not transmitted to the kickout drive linkage.

The principal purpose of providing adjustment of the kickout drive linkage is to ensure that excessive clearances and excessive impacting will not occur as the kickout linkage commences to produce the kickout operation. Therefore, the adjustment of the kickout drive linkage is connected to the adjustment of the backup screw, so that as the backup screw is adjusted, substantially a constant clearance is maintained between the surface 89 and the forked upper end of the kickout lever 24.

For example, if the kickout backup screw is adjusted to the left to move the extrusion pin 17 to the left and provide a longer shank on the rivet, the kickout linkage is automatically adjusted so that the forked end 23 moves to the left a corresponding distance. Conversely, when the kickout backup screw 26 is adjusted to the right to provide for a shorter rivet, the kickout linkage is adjusted to move the forked end 23 to the right a corresponding distance.

The timing of the machine is preferably arranged so that after the completion of the piercing operation a spring system returns the drive pin 21 to its initial position so that the desired small clearance is provided to eliminate any excessive hammering during the kickout operation. This spring system is schematically illustrated in FIG. 1 and includes a lever 91 pivoted at 92 and providing a lower forked end 93 engaging the forward end of the pin 21. A compression spring 94 within a spring retainer 96 urges the upper end of the lever 91 to the right, and in turn biases the pin 21 to the left. Therefore, when the pierce drive returns to its retracted position, the pin 21 returns to its retracted position before the commencement of the kickout operation.

It is recognized that the extrusion pin 17 will not move back with the drive pin because it is embedded in the workpiece, but the mass of the workpiece, the extrusion pin 17 and the relatively small diameter pin 19, is relatively small and does not produce excessive hammering when the clearance is taken up and the kickout action is actually commenced.

Figure 8:
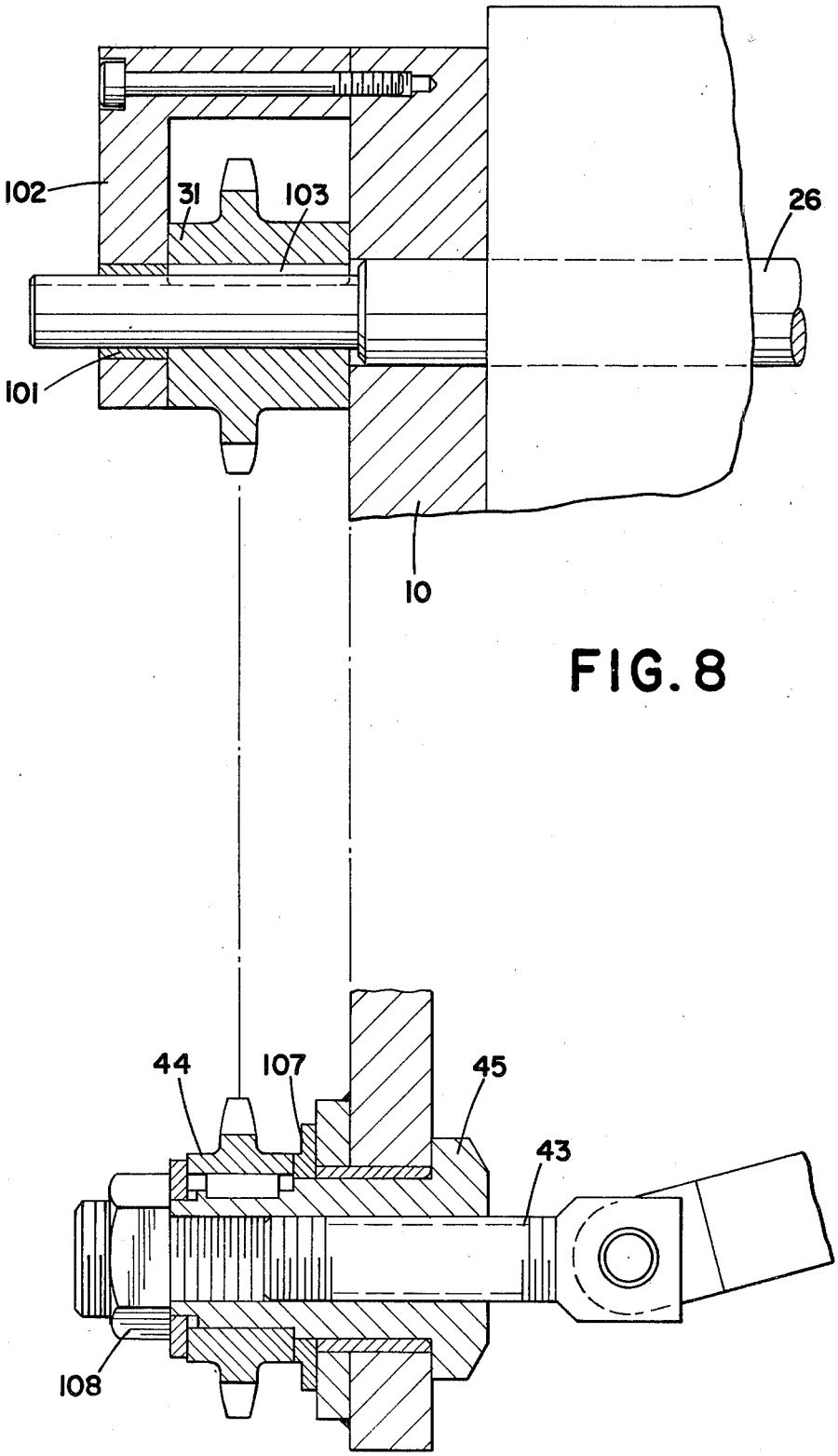
FIG. 8 is an enlarged, fragmentary section illustrating the adjustment of the backup screw and its interconnection with the adjustment of the kickout stroke.

The structure of the mounting of the sprocket wheels 31 and 44 and of their connections to their respective adjustment screws 26 and 43 illustrated in FIG. 8. The end of the screw 26 is journaled in a bearing 101 and an outrigger arm 102. The sprocket 31 is positioned between the frame 10 and outrigger arm 102 to restrain it against axial movement and is connected to the screw by a key 103 to prevent relative rotation while allowing the screw to move axially. The sprocket 44 is mounted on and keyed to an internally threaded nut 45 journaled in the spacer bushing 107. A nut 108 is threaded on the end of the nut 45 to secure the parts together and adjust end play. When the nut 45 is rotated, the adjustment screw 43 which is threaded into the nut is moved left or right, depending on the direction of rotation of the nut. The mounting of the sprocket 61 and its associated nut is similar to the mounting of the sprocket 61, so the structure of the latter mounting is not illustrated in detail.

With the present machine, it is possible to change the length of the rivet and the length of the tubular portion produced without requiring any tooling changes. The length of the rivet is determined by the adjustment of the kickout backup screw, which determines the rearwardmost position assumed by the extrusion pin, which in turn determines the length of the shank of the rivet by determining the mass of the workpiece within the die. The length of the tubular portion produced during the piercing operation is also adjustable without changing tooling, and, as mentioned previously, both adjustments can be performed while the machine is operating.

Although the various drives and adjustments are illustrated as applied to a double-blow header particularly suitable for producing rivets, it is within the broader aspects of this invention to apply such drives and adjustments to other types of forging machines, such as progressive headers or the like, and to use such apparatus for the production of other types of articles.

Although the preferred embodiment of this invention has been shown and described, it should be understood that various modifications and rearrangements of parts may be resorted to without departing from the scope of the invention as disclosed and claimed herein.

What is claimed is:

1. A forging machine comprising a die in which a workpiece is formed, tool means in said die engageable with said workpiece during the working thereof, adjustable backup means operable to position said tool means during at least a portion of the working of said workpiece, and a kickout drive operable to move said tool means along said die to eject said workpiece therefrom, said kickout drive being adjustable to change the distance said tool means are moved, and an interconnection connecting the adjustment of said backup means and the adjustment of said knockout drive operating to simultaneously adjust them and to maintain a predetermined relationship between the position of said back-up means and the distance through which said tool means is moved by said knockout means.

2. A forging machine as set forth in claim 1, wherein adjustment of said kickout drive changes the stroke thereof without changing the ejection position.

3. A forging machine as set forth in claim 2, wherein said interconnection prevents forming loads from being applied to said kickout drive while maintaining a small clearance therein to reduce hammering when said kickout drive operates.

4. A header or the like comprising a frame, a die station in said frame in which a workpiece is worked on two separate strokes, a tool in said die station operable to work the inner end of a workpiece in said die, a first power drive operable through a first stroke to move said tool along said die for working said inner end of said workpiece, and a separate second power drive operable through a second stroke to move said tool along said die to eject said workpiece therefrom, said first drive being adjustable to adjust the stroke said tool is moved to work said workpiece without changing its initial position, said second drive being adjustable to change its stroke without changing its final position.

5. A header as set forth in claim 4, wherein adjustable backup means adjustably determine the rearwardmost position of said tool.

6. A header as set forth in claim 5, wherein said backup means and said second power drive are interconnected so that both are adjusted in a related manner.

7. A header as set forth in claim 4, wherein each of said power drives includes a drive lever movable between first and second predetermined positions and each providing a curved drive surface, a driven link pivoted at one end and engaging an associated curved drive surface at its other end, and an adjustment for adjusting said other end of each driven link along its associated drive surface, one of said curved surfaces providing a center of curvature coincident with said pivot of its associated drive link when in said first position, the other of said curved surfaces providing a center of curvature coincident with said pivot of its associated drive link when in said second predetermined position.

8. A header as set forth in claim 7, wherein said drive levers are each driven by an associated rotary cam.

9. A forging machine comprising a frame, a die in said frame providing a die cavity in which a workpiece is formed, a tool projecting into said die cavity movable between an initial position and an operative position to form a workpiece in said die cavity, and a drive for moving said tool between said positions, said drive being adjustable while said machine is operating to change the location of said operative position without changing said initial position.

10. A forging machine as set forth in claim 9, wherein said workpiece is formed into a tubular rivet, and said tool is an extrusion pin which extrudes a tubular end portion on said rivet as it is moved to its operative position.

11. A forging machine comprising a frame, a die in said frame in which workpieces are formed, a kickout pin means in said die, first adjustable means operable to determine the rearwardmost position of said kickout pin means, and an adjustable powered kickout drive operable to move said kickout pin means from said rearward position to an extended position to eject a workpiece from said die, said adjustable means and said adjustable power drive being interconnected so that adjustment of said rearward position causes a corresponding adjustment of said kickout drive.

12. A double-blow header for producing semitubular rivets or the like from cylindrical workpieces comprising a die station with an extrusion pin therein, a pair of tools operable to sequentially cone and finish the head of said workpiece, adjustable positioning means operable to locate said extrusion pin during the coning of said workpiece and thereby adjustably determine the mass of material in the shank of the workpiece, a first drive adjustably operable to move said extrusion pin forward to extrude a tubular end thereon while said tools finish the head of said workpiece, and a second drive operable to thereafter move said extrusion pin forward to eject said workpiece from said die, said first drive being adjustable while said header is operating permitting adjustment of the depth of said tubular end during stabilized conditions of operation.

13. A double-blow header as set forth in claim 12, wherein said positioning means is adjustable while said header is operating, permitting adjustment of the mass of material in said shank of said workpiece while said header is operating under stabilized conditions.

14. A double-blow header as set forth in claim 13, wherein said second drive is adjustable while the header is operating, said second drive adjustment and said positioning means adjustment being interconnected so that their adjustment is made in a predetermined manner.

* * * * *